US005787952A

United States Patent [19]

Wegner

[11] Patent Number: 5,787,952

[45] Date of Patent: Aug. 4, 1998

[54] DISAPPEARING SCREEN

[76] Inventor: Gary D. Wegner, N. 30 W. 28706 Lakeside Dr., Pewaukee, Wis. 53072

[21] Appl. No.: 664,667

[22] Filed: Jun. 17, 1996

Related U.S. Application Data

[63] Continuation-in-part of Ser. No. 318,197, Oct. 5, 1994, Pat. No. 5,544,689, which is a continuation of Ser. No. 62,999, May 17, 1993, abandoned.

[51] Int. Cl.[6] ..... A47H 1/00

[52] U.S. Cl. ..... 160/100; 160/313; 160/323.1

[58] Field of Search ..... 160/100, 27, 28, 160/323.1, 313, 23.1, 98, 99, 191, 903, 405, 290.1

[56] References Cited

U.S. PATENT DOCUMENTS

| | | | |
|---|---|---|---|
| 602,553 | 4/1898 | Casselberry | 160/903 X |
| 975,146 | 11/1910 | Manelius | 160/313 X |
| 1,038,138 | 9/1912 | Hikes | 160/27 X |
| 1,082,339 | 12/1913 | Kelly | 160/903 X |
| 1,252,286 | 1/1918 | Masson | 160/903 X |
| 1,844,599 | 2/1932 | Renzetti | 160/28 |
| 1,942,308 | 1/1934 | Renzetti | 160/28 |
| 2,514,274 | 7/1950 | Zagrodny | 160/27 |
| 2,575,128 | 11/1951 | Renzetti | 160/28 |
| 4,390,054 | 6/1983 | Niibori et al. | 160/265 |
| 4,671,557 | 6/1987 | Lemp | 160/323.1 X |

*Primary Examiner*—David M. Purol
*Attorney, Agent, or Firm*—David George Johnson

[57] ABSTRACT

An integrated window screen system including a roller screen assembly which provides for out of view storage of the screen material (22). The screen material (22) is attached to the sash (10) of a double hung or similar window. The opposite edge of the screen (22) is attached to a roller drum (30) mounted on a shaft (78). The drum (30) is mechanically interconnected to a spring motor (26) which includes a constant force spring (62) which has the effect of keeping the screen (22) taut when deployed. The roller drum (30) is located below the window sill (50).

4 Claims, 4 Drawing Sheets

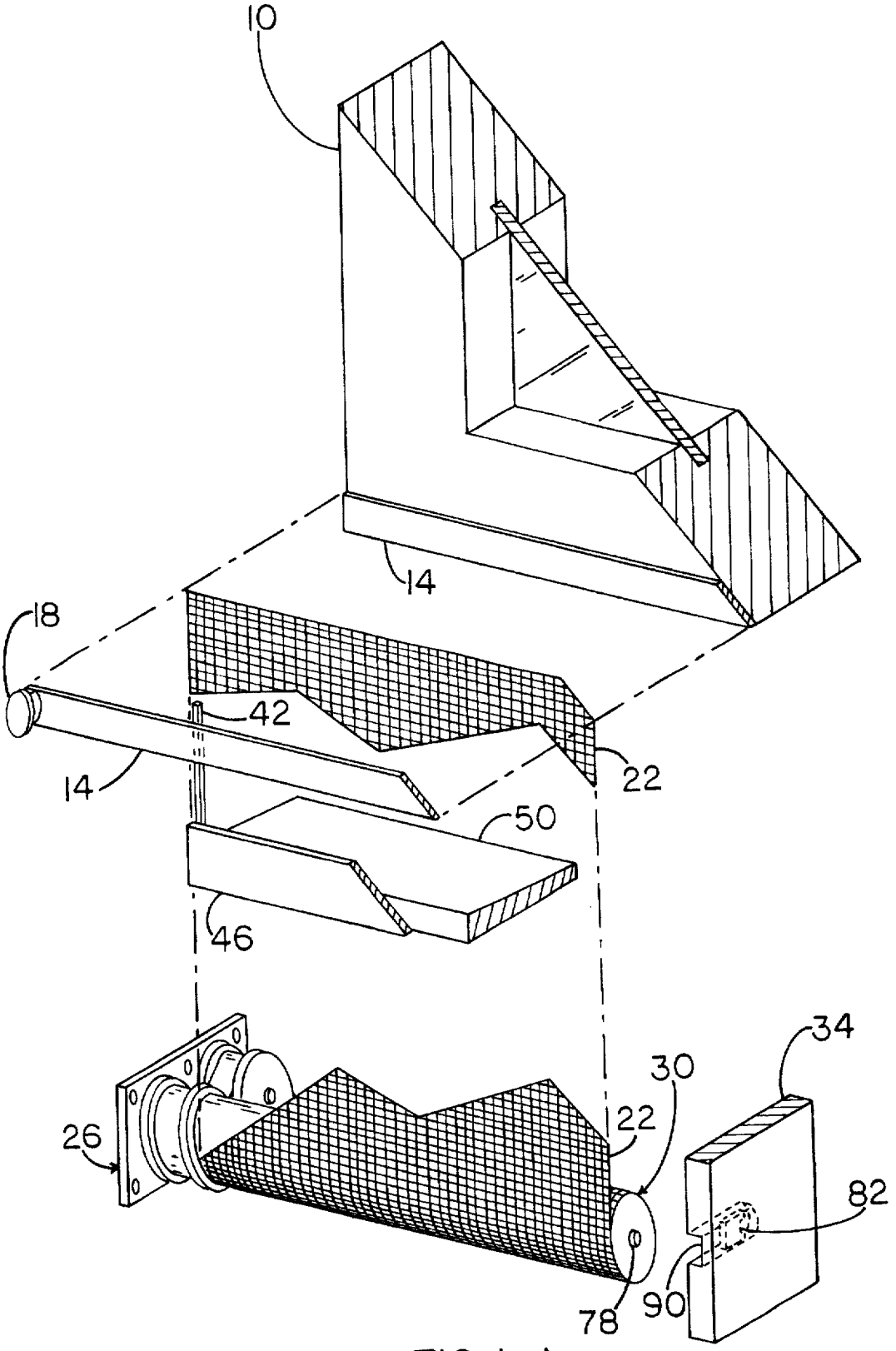
FIG-1-A

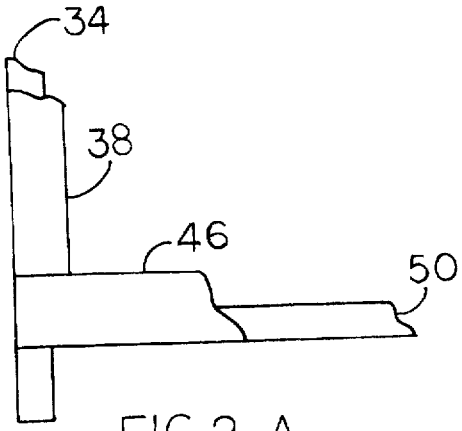
FIG.2-A
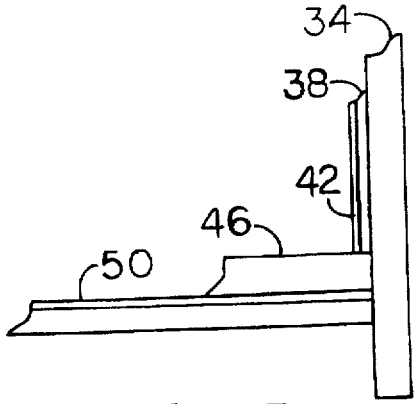
FIG.2-B
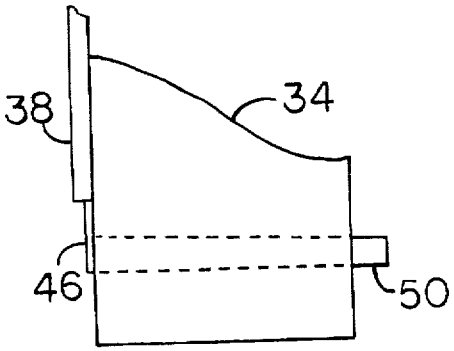
FIG.2-C
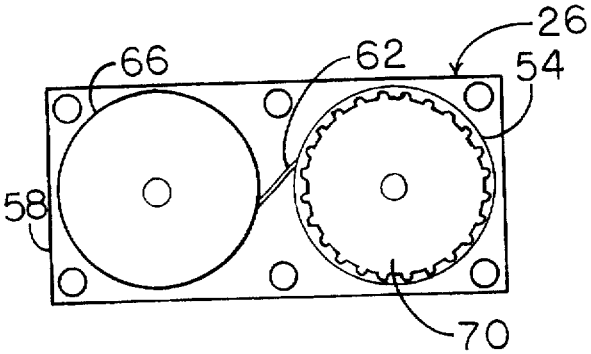
FIG.3-A
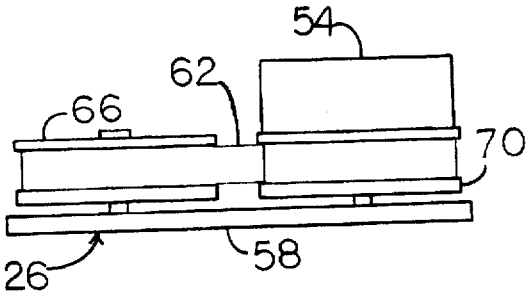
FIG.3-B
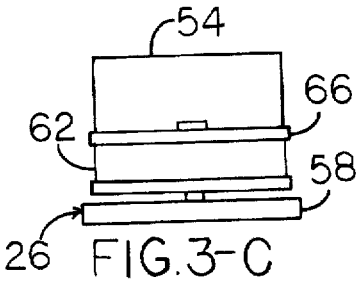
FIG.3-C

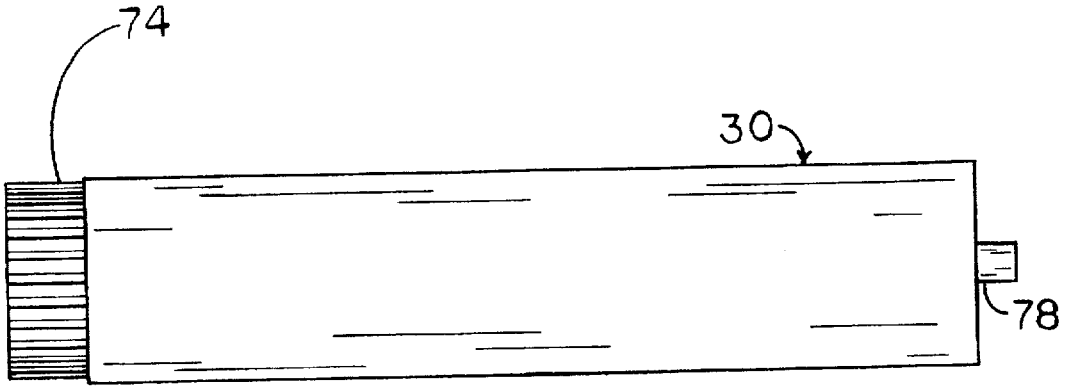
FIG.4-A
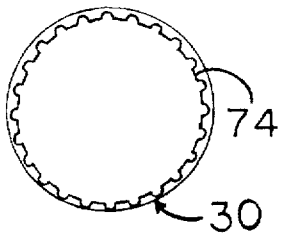
FIG.4-B
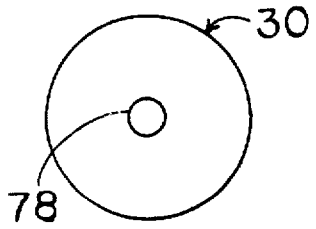
FIG.4-C
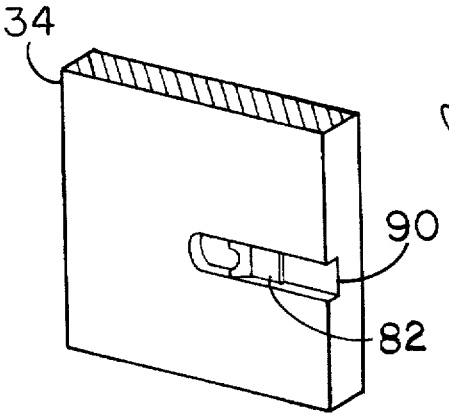
FIG.5
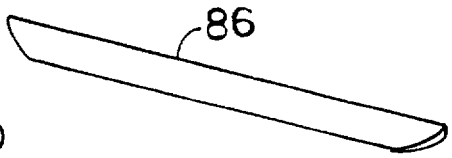
FIG.6

DISAPPEARING SCREEN

This application is a continuation in part of application Ser. No. 08/318,197, filed on Oct. 5, 1994, which issued as Pat. No. 5,544,689 on Aug. 13, 1996, which is a continuation of application Ser. No. 08/062,999, filed on May 17,1993, now abandoned.

BACKGROUND OF THE INVENTION

1. Field of the Invention

The present invention relates to a roller screen and more particularly to an integrated window screen system providing out of view storage of a window screen so as to permit a previously unknown method of use.

2. Description Of The Related Technology

The application of window screens known to this point in time has been primarily comprised of framing a screen material and subsequently mounting that frame over a window.

A person that may desire a dear, unobstructed view through a window has previously, had to remove the framed screen. Although these screens are generally removable and not a permanent component of most window assemblies, the removal of window screens has been inconvenient. Providing storage for the framed screen so as to prevent damage to the screen and, simultaneously, keep this screen available for ready use has been difficult. Indeed, this method has been so impractical that it is generally not even used on windows that are closed a majority of the time.

Given the advanced state-of-the-art that window manufacturers have attained in clarity it is only natural that a consumer would not wish to inhibit his or her view with a window screen that obstructs up to 40% of available light.

Although some applications of roller screens have been produced, these roller screens have fallen short of solving the aforementioned problem. Previous roller screens have been expensive and cumbersome articles. The excessive weight and size requirements of electrical motors and complex metal winding mechanisms, for example, that have been the embodiment of related art, have made most actual applications impractical.

One major difficulty that industry has not yet overcome is that of excess torsional force. This is a load force that builds up within the coils of the helical compression springs common in the related art. When the roller screen is pulled down this force builds up to very high levels. So high, in fact, that many would be consumers find it uncomfortable to pull the roller screen down. Another difficulty associated with this excess torsional force is rapid retraction of the roller screen. The loading force builds up in the coils of the compression spring while the roller screen is being pulled down. This loaded force then causes the roller screen to retract so rapidly that it has actually startled some operators. The excess force inherent with the related art certainly limits the scope of installations in which application is practical, and in some cases even possible.

Importantly, many previous roller screens have not been designed as an integrated window system but rather as their own separate entity, to be applied over a window. Commonly, the roller screen is housed above the window with this housing being visible to persons inside the room. The screen must be first reached and then pulled down by hand. Furthermore, this device is commonly available only on casement windows. Due in part to high costs associated with the related art, consumers rarely purchase these devices.

In practice, the related art does not address the same problem and concerns as does the present invention as no like system now exists.

SUMMARY OF THE INVENTION

It is a primary object of the present invention to provide a heretofore unknown method for the application of a roller screen. This new system provides for the attachment of a screen material directly to a window sash of a double hung or similarly operating window. It therefore provides for the operation of the screen simply with the movement of this window. The present invention also provides for out-of-view storage of the screen material while the window is in the dosed position, thus providing the user a clear and unobstructed view.

A further object of the present invention is to eliminate the excess torsional force built up in helical compression and spiral springs of the related art. This is accomplished with the application of a constant-force spring, therefore eliminating the need for a helical compression spring or spiral spring. The constant-force spring is extended, more accurately termed deflected, while itself resisting the loading force associated with the aforementioned springs.

The constant-force spring is capable of exerting constant or controlled varying force through extreme deflections, its characteristics are radically different from those of conventional spring members. The characteristics of the constant-force spring are distinguishing physical and functional properties compared with conventional spiral and extension springs. The most common requirements which affect the design of all spring members are force (or torque), deflection (or revolutions), space considerations, and fatigue life. The relation of fatigue and stress, dimensions, gradient, force, deflection, and treatment of other appropriate factors such as spring materials and mounting methods require the use of the constant-force spring in the present invention.

The constant-force spring is a strip of flat spring material which has been given a curvature by continuous heavy forming so that in its relaxed or unstressed condition the constant-force spring is in the form of a tightly wound spiral. In its relaxed position no part of the coiled spring stock is stressed by external causes. The outer end of the constant-force spring is then extended by a force, and the constant-force spring, mounted for free rotation, is then partly uncoiled.

The force at any extension is determined only by the work required to deflect the material from its coiled condition. The force remains constant with extension as long as each incremental length of the constant-force spring has an equal increase in stress as it is deflected. This condition represents a constant-force spring having a zero gradient. The material is therefore put under stress, and energy stored in it is proportional to the length of deflected material.

As an aid in visualizing the unique characteristics of the constant-force spring and in evaluating its usefulness as a spring member, observe the comparison of the constant-force spring with a representative spiral spring. The comparison gives eleven characteristics which differentiate a zero-gradient constant-force spring from a spiral spring, the most nearly similar conventional spring type.

CHARACTERISTICS DIFFERENTIATING ZERO-GRADIENT CONSTANT-FORCE SPRING FROM SPIRAL SPRING

| Conventional Spiral Spring | Constant-Force Spring (zero gradient) |
|---|---|
| 1 Cumulative stress limits possible deflection. | 1 Noncumulative stress does not limit deflections. |
| 2 Forces equals that required at one point only. Excessive or insufficient force at all other points. | 2 Force substantially constant throughout entire deflection |
| 3 End of spring is anchored for winding. | 3 Spring is mounted for free rotation of coil. |
| 4 Spiral spring is normally open to allow for winding. | 4 Normally tight wound with each coil in close contact with adjacent turns. |
| 5 Charged by winding to a tight spiral. | 5 Charged by uncoiling outer end of spring. |
| 6 Force developed increases as winding progresses. | 6 Substantially full force at initial deflection. |
| 7 Force delivered angularly or by means of auxiliary member such as a drum, when it is delivered tangentially. | 7 Force delivered linearly from center of coil to extended end of spring. |
| 8 Spring is stressed as a unit by winding. | 8 Spring is stressed sequentially by increments. |
| 9 Working range is open spiral to tight wound. | 9 Working range from tight spiral to straight or even reverse coiled. |
| 10 Space required for expansion when unwound. | 10 Space required for tight spiral only. |
| 11 Substantial losses due to intercoil friction during winding and unwinding. | 11 No intercoil friction. |

Characteristics 1 and 2 represent the most important differences in operation. Primarily, because stress is noncumulative, a change in deflection of the constant-force spring does not affect the stress of the material. The force delivered by the constant-force spring does not depend upon deflection. The remaining characteristics concern differences in anchoring methods, unstressed condition, method of charging, force development and delivery, stress, working range, space, and intercoil friction.

Thus, the present invention provides for a constant torsional force with no load build up. This provides for previously unknown ease of use thus allowing for heretofore unknown applications of a roller screen. In fact, the primary object of the present invention is aided by the use of the constant-force spring. This spring makes possible retraction of the screen material without itself exerting additional force to the window sash.

Accordingly, several ensuing advantages of my invention are to provide for a new inexpensive roller screen assembly. This new system is not cost prohibitive to either manufacturers or the public.

Furthermore, this new system aids consumers in the cleaning of double hung or similarly operating windows, including those with tilt sash. This is accomplished by providing for a mere unfastening of the screen material from the window sash. The unfastening can be performed from inside the room, this eliminating the need for a person to remove a framed screen. Often these screens are mounted on the outside of a window, and many times, on the second floor or higher.

Also, replacement of a damaged screen could be done easily. The compact size of the new roller drum allows for the drum to be mounted within the window frame, therein behind a molding. Wood moldings are generally installed around the inside edges of a window for finishing purposes. After removal of a molding, the roller drum can be easily removed and a replacement screen attached. As the present invention provides for a simple mechanism this can be accomplished by a consumer without the need for special skills or tools.

Additionally, the materials preferred for construction of the present invention provide for a very durable device. The components are not subject to corrosion or wear which normally results from a lack of lubrication. Also, the constant-force spring has a proven reliability of many tens of thousands of cycles without failure.

BRIEF DESCRIPTION OF THE DRAWINGS

In the drawings, closely related figures have the same number however different alphabetic suffixes.

FIG. 1-A presents a perspective sectional view of the Disappearing Screen including additional detail.

FIG. 2-A is an interior elevation view of the window assembly with the sill extension mounted thereon.

FIG. 2-B is an exterior elevation view of the window assembly with the sill extension mounted thereon.

FIG. 2-C is a side elevation view of the window assembly with the sill extension mounted thereon.

FIG. 3-A is a face elevation view of the constant-force spring motor.

FIG. 3-B is a side elevation view of the constant-force spring motor.

FIG. 3-C is an end elevation view of the constant-force spring motor.

FIG. 4-A is a side elevation view of the roller drum assembly.

FIG. 4-B is an end elevation view of the roller drum with the roller drum drive mounted thereon.

FIG. 4-C is an end elevation view of the roller drum with the roller shaft mounted thereon.

FIG. 5 shows a perspective view of the jamb with the roller shaft retention clip mounted therein.

FIG. 6 shows a perspective view of the flexible sash sweep.

Reference Numerals In Drawings

Figure 1:
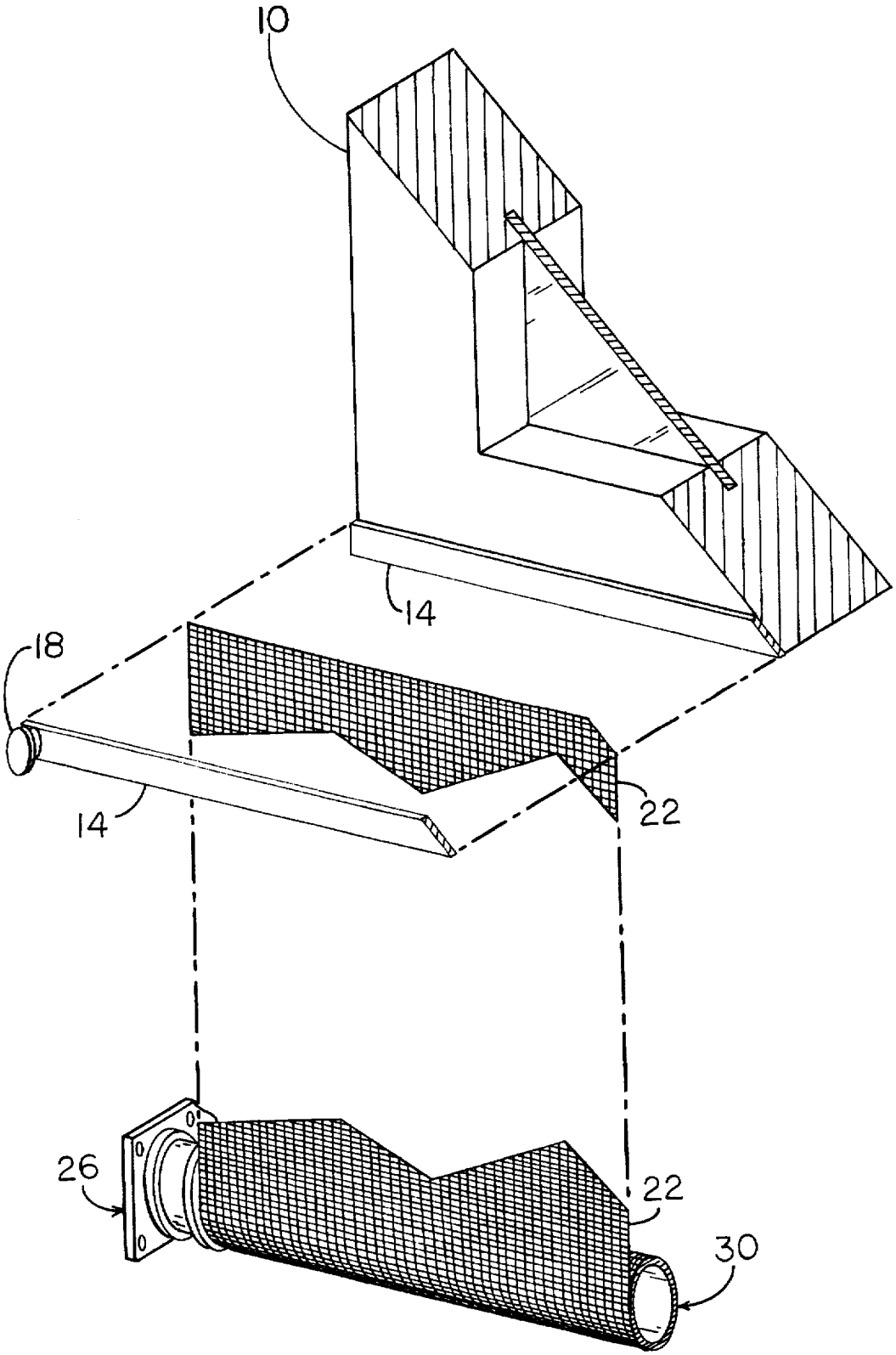
FIG. 1 shows a perspective sectional view of a basic version of the Disappearing Screen.

| | |
|---|---|
| 10 window sash | 54 roller drum drive receptor |
| 14 reclosable fastener | 58 constant-force spring motor base |
| 18 screen disconnect pull | 62 constant-force spring |
| 22 screen material | 66 storage drum |
| 26 constant-force spring motor | 70 output drum |
| 30 roller drum | 74 roller drum drive |
| 34 jamb | 78 roller shaft |
| 38 jamb facing | 82 roller shaft retention clip |
| 42 insect barrier | 86 flexible sash sweep |
| 46 sill extension | 90 groove in jamb |
| 50 sill | |

DESCRIPTION OF THE PREFERRED EMBODIMENT

The present invention will now be described in detail with reference to the drawings. Shown in FIG. 1 is a screen material 22, which is attached at one end to a roller drum 30, preferably by a pressure sensitive adhesive material. Screen material 22 is attached at the opposite end to window sash 10. As embodied screen material 22 is securely mounted to sash 10 by sandwiching screen material 22 between reclosable fastener 14 and reclosable fastener 14. The screen material 22 is wrapped around the roller drum 30 so as to allow for a sufficient amount of screen material 22 to remain on roller drum 30 when the screen material 22 is fully deployed. Roller drum 30 may be mounted and housed either horizontally or vertically as further embodiments may require.

FIGS. 2-A, 2-B, and 2-C show the preferred embodiment of sill extension 46. Sill 46 is required for the purpose of impeding the entry of weather elements into the indoor living area at the sill 50 level. Sill extension 46 is preferably constructed of a sturdy material so as to perform the function of conventional sill extensions while consisting of a reduced thickness of material. The sill extension 46 is mounted upon sill 50 and jamb 34 by a weather proof method.

FIG. 2-B clearly shows the preferred embodiment of insect barrier 42 which is mounted upon jamb facing 38. Insect barrier 42 maintains contact with the edges of screen material 22 in order to insure the integrity of screen material 22 as an insect barrier. It is preferred that insect barrier 42 be constructed of a pliable material.

Presented in FIGS. 3-A, 3-B, and 3-C is constant-force spring motor 26. The constant-force spring motor 26 contains constant-force spring 62 mounted upon storage drum 66. One end of constant-force spring 62 is attached to output drum 70. Extending from output drum 70 is roller drum drive receptor 54. The constant-force spring motor base 58 is mounted upon the portion of jamb 34 which proceeds beyond sill 50 and is thus mounted perpendicular to sill 50.

Presented in FIGS. 4-A, 4-B, and 4-C is roller drum 30, to be comprised of a hollow pipe-like structure and constructed of an element which is of adequate strength so as to resist bending or flexing during deployment of the screen material 22. Such element also to be of a non-corrosive nature and ultimately lightweight. The preferred element for construction of the roller drum 30 being a polymer material. Additionally shown in FIGS. 4-A, 4-B, and 4-C are roller drum drive 74 and roller shaft 78, both to be constructed of an element similar to that comprising roller drum 30. Roller drum drive 74 contains a spline design to allow for compatibility with roller drum drive receptor 54. Roller shaft 78 is designated to maintain the position of one end of roller drum 30 while allowing the same to rotate. A receptacle to accommodate roller shaft 78 is provided at the window frame or jamb.

In the perspective view presented as FIG. 5 the relationship between roller shaft retention clip 82, with reference to a receptacle to accommodate the roller shaft retention dip 82, being groove in jamb 90, and jamb 34 can be dearly seen.

Referring now to FIG. 6, an embodiment of the flexible sash sweep 86 is shown. The flexible sash sweep 86 to be mounted upon the lower edge of the window sash 10 directly above the lower glass pane. This is to be accomplished in such a manner so that flexible sash sweep 86 maintains contact with the opposite sash and glass pane to provide an insect barrier between the upper and lower sash.

Now the operation and usage of the disappearing screen will be explained, with reference to the embodiment presented in FIG. 1 of the drawings.

The manner of utilizing the disappearing screen is unlike that of any related art. In order to use this new system a consumer must only operate the window to which this system is attached. Opening of the window causes the screen material 22 to be deployed, thus filling the opening therein created. This being accomplished due to the attachment of screen material 22 to the window sash 10 by sandwiching screen material 22 between reclosable fastener 14 and reclosable fastener 14 which in turn are securely mounted to the window sash 10. Therefore, a consumer need not perform any additional task to provide an insect barrier aside from the basic operation of the window.

The attachment of screen disconnect pull 18 to reclosable fastener 14 allows for the rapid disconnection of screen material 22 from window sash 10 and enables the window to be used as a fire escape, even by young children.

As the window opening operation is occurring, the required screen material 22 is unrolled from below the sill 50. As this is occurring, screen material 22 travels upward past the interior face of sill extension 46. As the screen material 22 continues to travel upward its side edges maintain contact with insect barrier(s) 42.

Below the sill 50 is found roller drum 30. Roller drum 30 being simultaneously held in fixed position and allowed to rotate longitudinally. At one end, mounting of the roller drum 30 to jamb 34 is accomplished through roller shaft 78. Roller shaft 78 being held in place within the receptacle of jamb 34 by roller shaft retention dip 82. At the other end of the roller drum 30, roller drum drive 74 allows for the mounting to the constant-force spring motor 26 through roller drum drive receptor 54. The roller drum drive 74 and the roller drum drive receptor 54 share a compatible spline design. The constant-force spring motor 26 is mounted to jamb 34 through constant-force spring motor base 58.

Rotation of roller drum 30 is made possible therefore by the rotation of roller shaft 78 and by the rotation of roller drum drive 74 which is housed within roller drum drive receptor 54. Roller drum drive receptor 54 being mounted upon the rotating output drum 70 of the constant-force spring motor 26.

An important operational component of the disappearing screen is constant-force spring 62. The constant-force spring 62 consists of a spiral of strip material with built-in curvature. Each turn of the strip material wraps tightly on its inner neighbor. The inherent stress of this strip material resists loading force at a nearly constant rate. Connecting the roller drum 30, at roller drum drive 74, to the roller drum drive receptor 54 of the constant-force spring motor 26 and hence the constant-force spring 62 causes several actions to occur. One of these actions is to keep the screen material 22 taught while deployed. Another of these actions is to retrieve the screen material 22 upon the roller drum 30 when the window unit it is attached to is closed. Both actions are accomplished without having to overcome the excess load force inherent in the related art.

Furthermore, the window remains open without the application of an extraneous device. The nature of the constant-force spring 62 provides for this on windows with even a minimal resistance to movement.

This application is, therefore, intended to cover any variations, uses, or adaptations of the invention following the general principles thereof and including such departures from the present disclosure as come within known or customary practice in the art to which this invention pertains and fall within the limits of the appended claims.

I claim:

1. A method of installing a window screen, comprising the steps of:

a. mounting a flexible screen material onto a drum;

b. mounting the drum adjacent to a window such that the drum is rotatable about a longitudinal axis;

c. rotating the drum such that a free edge of the flexible screen material follows a path tangential to a perimeter surface of the drum;

d. applying a constant biasing force to the drum such that the angular acceleration of the drum about the longitudinal axis is substantially constant;

e. mounting a constant force spring about a spool so as to bias the spool for rotation about a longitudinal axis of the spool;

f. interconnecting the biased spool to the drum so as to bias the drum for rotation about a longitudinal axis of the drum;

g. mounting a first spool and a second spool onto a base, the first spool serving as an output spool and the second spool serving as the take up spool for a substantially constant force spring;

h. forming a groove within a window jamb, the groove being dimensioned to receive an end portion of the drum; and i. mounting a retention clip within the groove, the retention clip tending to retain the end portion of the drum in the groove.

2. The method of claim 1, further comprising the step of affixing the free end of the flexible screen material to a window sash, thereby causing the drum to rotate in response to movement of the sash.

3. The method of claim 2, further comprising the step of guiding the flexible screen material that is unwound from the drum so as to retain the flexible screen material within a plane.

4. The method of claim 3, further comprising the step of mounting a screen retaining assembly onto the window sash so grip the flexible screen material within the screen retaining member.

* * * * *